United States Patent [19]

Knöös

[11] Patent Number: 4,766,833

[45] Date of Patent: Aug. 30, 1988

[54] STEERING GEAR FOR A YACHT

[76] Inventor: Stellan P. Knöös, 5933 Avenida Chamnez, La Jolla, Calif. 92037

[21] Appl. No.: 882,907

[22] PCT Filed: Oct. 23, 1985

[86] PCT No.: PCT/SE85/00413

§ 371 Date: Jun. 25, 1986

§ 102(e) Date: Jun. 25, 1986

[87] PCT Pub. No.: WO86/02614

PCT Pub. Date: May 9, 1986

[30] Foreign Application Priority Data

Oct. 26, 1984 [SE] Sweden ..... 8405379-2

[51] Int. Cl.[4] ..... B63H 25/04

[52] U.S. Cl. ..... 114/144 C

[58] Field of Search ..... 114/144 C

[56] References Cited

U.S. PATENT DOCUMENTS 4,078,511 3/1978 Daniels ..... 114/144 C 4,327,657 5/1982 Knoos ..... 114/114 C

OTHER PUBLICATIONS

"Windselbststeueranlagen" by Volz/Mohr, 1977, pp. 128, 129, 146 and 147.

"Die Yacht" journal, No. 1, 1972, pp. 83–87.

"Windsteueranlage Windpilot IV Pacific of John Adam" brochure, 1975.

*Primary Examiner*—Joseph F. Peters, Jr.

*Assistant Examiner*—Thomas J. Brahan

*Attorney, Agent, or Firm*—Larson and Taylor

[57] ABSTRACT

A wind vane steering gear for a yacht comprises a bracket adapted for attachment to the transom of the yacht, a rocker which is pivotally movable on the bracket about a rocker axis in the longitudinal vertical center plane of the yacht, rudder coupling tackle connecting the rocker with the yacht rudder, a servo oar mounted on the rocker and pivotally movable therewith and rotatable relative to the rocker about an oar axis perpendicular to the rocker axis, and a steering arm which is provided with a wind vane and pivotally mounted on a support member carried by the bracket with the pivot axis situated in the same plane as the rocker axis, the steering arm being coupled to the servo oar by a linkage so that pivotal motion of the steering arm causes the servo oar to be rotated and thereby, under the action of hydrodynamic forces, to be pivotally moved together with the rocker about the rocker axis. The wind vane is adjustable to different positions by means of an actuating member at the upper end of the steering arm.

13 Claims, 3 Drawing Sheets

42
S
61
66
4
68
T
14
49
41
40
10
C
15
11
24
16
V
12
L
13
31
32
37
38
R

STEERING GEAR FOR A YACHT

This invention relates to steering gear for a yacht, and, in particular, to steering gear of the kind defined in the preamble of the independent claim.

The invention accordingly relates to steering gear in which a pivotally movable steering arm, such as a pivoted arm provided with a wind vane or otherwise producing or transmitting steering signals, is supported on a bracket and arranged to rotate a servo oar supported by a rocker, such that the servo oar is caused by hydrodynamic forces to be pendulously moved and thereby to pivotally move the rocker, which in turn actutates a rudder to deflect it.

Such steering gear is disclosed in U.S. Pat. No. 3,983,831 and U.S. Pat. No. 4,327,657. The steering gear disclosed in the first-mentioned patent specification has a separate or auxiliary rudder rotatably mounted on the bracket and, consequently, is independent of the yacht's own or main rudder, while the steering gear disclosed in the second patent specification is adapted for use in conjunction with the yacht's main rudder. The last-mentioned steering gear therefore can be constructed from fewer and simpler components and, accordingly, can be made cheaper.

An object of the present invention is to bring about further simplification of the steering gear and thereby make possible further reduction of the number of components and a simple connection to autopilots existing on the market.

To this end, in the steering gear according to the invention, the steering arm is pivotally supported on the bracket and the pivot axis of the steering arm is stationary with respect to the pivot axis of the rocker.

While in the steering gear disclosed in the above-mentioned patent specifications the orientation of the pivot axis of the steering arm is changed upon setting the course to be kept by the yacht, the steering arm pivot axis of the steering gear according to the invention has a fixed orientation which suitably is such that the axis is slightly inclined forwardly and upwardly, as viewed from a position behind the yacht and the steering gear, and is contained in a longitudinal vertical plane also containing the pivot axis of the rocker. Suitably, this vertical plane is the longitudinal centre plane of the yacht.

Because the pivot axis of the steering arm is stationary with respect to the bracket, the transmission of motion from the steering arm to the servo oar can be effected by a linkage which is simpler than that of the known steering gear. A further advantage is that the journal for the steering arm can be placed at a low level and, consequently, a steering force acting on the steering arm, e.g. on a wind vane supported by or forming part of the steering arm, can be transmitted to the servo oar with a favourable lever ratio.

In another aspect, steering gear according to the invention comprises: a bracket adapted for attachment to the transom of a yacht, said bracket comprising means for attaching said bracket in fixed position to the transom of a yacht, means for pivotally mounting a rocker on said bracket, and means for pivotally mounting a steering arm on said bracket independently of said rocker; a rocker pivotally mounted on said bracket and being pivotally movable relative to the bracket about a rocker axis which extends generally in the fore and aft direction of the yacht when the bracket is attached to the transom and being connectable to a rudder member such that the rudder member is deflected in response to pivotal motion of the rocker about the rocker axis; a servo oar supported by the rocker and pivotally movable together with the rocker about the rocker axis, the servo oar being rotatable relative to the rocker about an oar axis which is generally perpendicular to the rocker axis; and a steering arm pivotally mounted on said bracket independently of said rocker, said steering arm being pivotally moveable about a steering arm axis; linkage means coupling the steering arm to the oar such that the oar is rotated about the oar axis in response to pivotal motion of the steering arm axis.

Further features and advantages of the steering gear according to the invention are apparent from the following description of a preferred embodiment.

Figure 1:
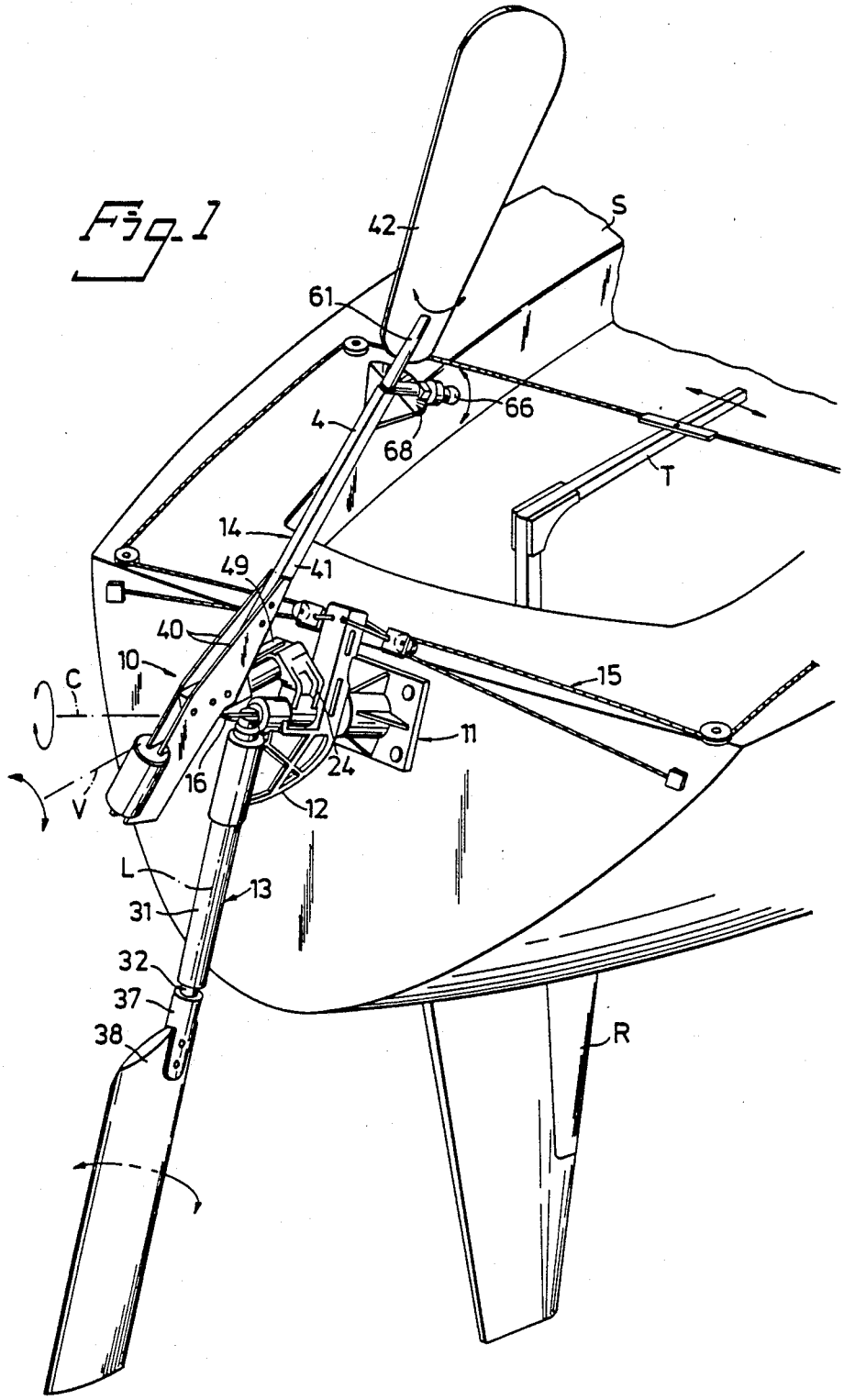
FIG. 1 is a perspective view of the aft portion of a yacht to which a steering gear according to the invention is attached.

As illustrated, the steering gear 10 comprises as main parts: a bracket 11 attached to the transom of a yacht S; a rocker 12 pivotally supported by the bracket; a servo oar 13 rotatably supported by the rocker; and a steering arm 14 pivotally supported by the bracket and provided with a wind vane. The steering gear 10 also comprises rudder coupling tackle 15 connecting the rocker 12 with the tiller T of the yacht rudder R to convert pivotal motion of the rocker into rudder deflection, and a linkage 16 connecting the steering arm 14 with the oar 13 to convert the pivotal motion of the steering arm into rotational motion of the oar.

The bracket 11 comprises a pedestal 20 having (a) a tubular neck 21, (b) an axle 23 having one end thereof received in the neck and removably secured thereto by means of a locking screw 22, and (c) a support 24 mounted on the axle in a position spaced from the pedestal and removably secured to the axle by means of a locking screw 25. When the bracket is properly secured to the transom of the yacht, the axis C of the axle 23 is positioned substantially in the longitudinal centre plane of the yacht and is slightly inclined forwardly and downwardly. In the illustrated example, the angle of inclination to the designed waterline plane of the yacht is 22°, but this angle may have other numerical values, e.g. within the range 10°–35°.

The rocker 12 is provided with a pair of spaced journal portions 26 by means of which the rocker is pivotally mounted on opposite sides of the support 24 on the portion of the axle 23 projecting in cantilever fashion from the pedestal 20. Bearings 27 and 28 positioned between the journal portions 26, on the one hand, and the axle 23 and the support 24, on the other hand, ensure minimal frictional resistance to the rocker motion about the axis C of the axle 23.

Figure 2:
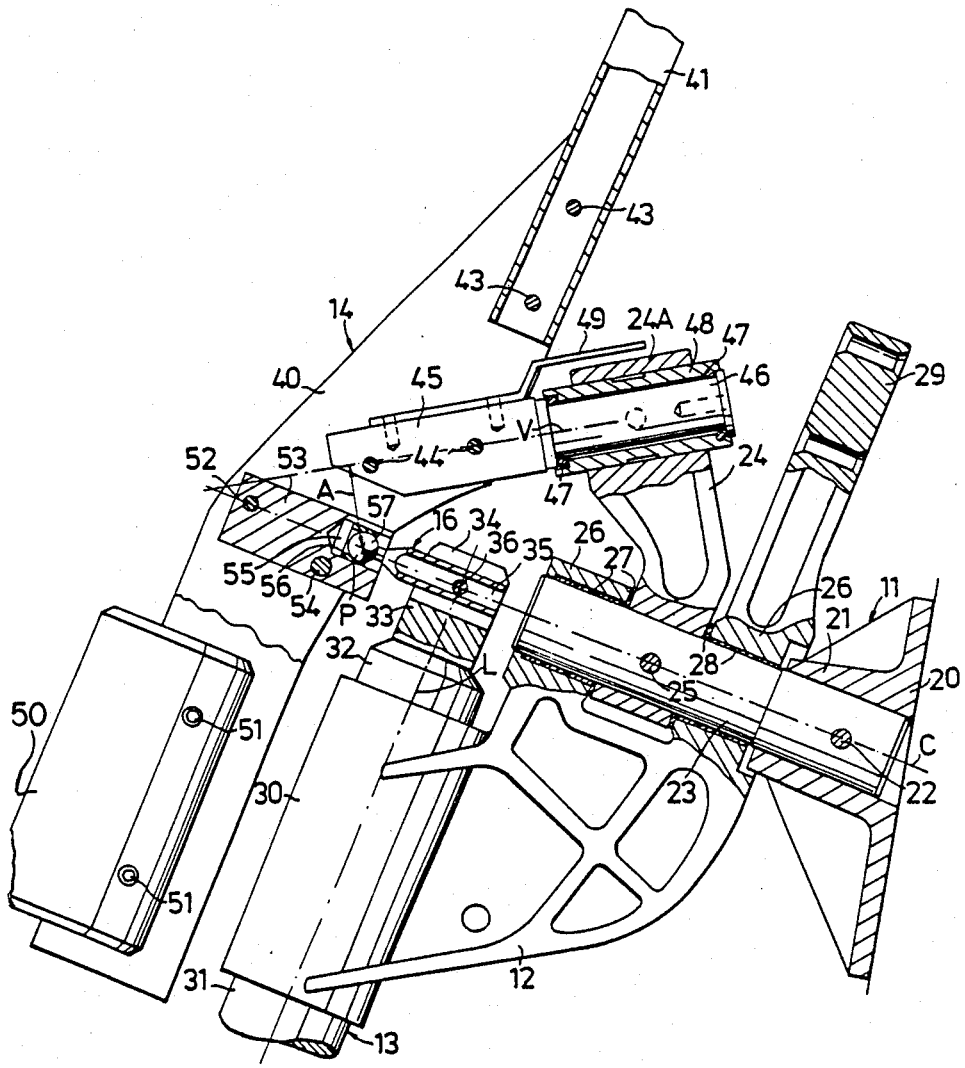
FIG. 2 is an elevational view, partly sectional, of the central portion of the steering gear shown in FIG. 1.
Figure 3:
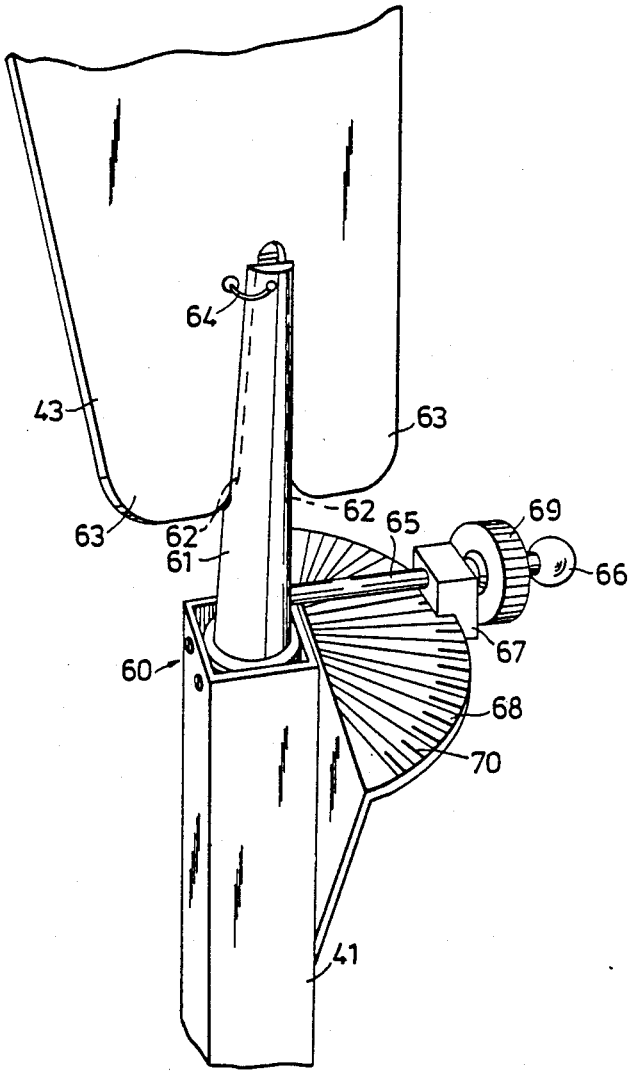
FIG. 3 is an enlarged perspective view, partly sectional, of the upper portion of the steering arm of the steering gear shown in FIG. 1.

The rocker 12 and the support 24 are shaped such that the rocker is free to swing 90° or more in either direction from a neutral position, namely, the position shown in FIGS. 1 and 2.

Adjacent the front journal portion 26, i.e. the journal portion adjacent the pedestal 20, the rocker 12 has an upward projection 29, to which the rudder coupling tackle 15 is connected. The rudder coupling tackle 15 comprises a cable and pulley system connected to the projection 29 and to the tiller T such that the position of the tiller always corresponds to the angular position of the rocker. Naturally, the rudder connecting tackle can readily be disconnected.

The rocker 12 also has a journal portion 30 within which a support tube 31 is mounted. Within this support tube, a shaft 32 of the oar 13 is mounted by means of roller and journal bearings, not shown, such that it can be rotated almost non-frictionally about its own axis L which coincides with that of the support tube and is perpendicular or substantially perpendicular to the axis C of the axle 23 and which intersects that axis at a point behind the free end of the axle 23.

In an axial slot 34 at the upper end 33 of the oar shaft 32 a portion of a link rod 35 of the linkage 16 is received. A pivot pin 36 extending transversely through the walls of the slot pivotally supports the link rod 35. The axis of the pivot pin 36 is positioned on or near the extension of the axis C of the axle 23 and on or near the intersection of the axis C and the axis L of rotation of the servo oar 13.

In other respects, the servo oar 13 is constructed substantially as the servo oar of the steering gear according to U.S. Pat. No. 4,327,657. Adjacent the lower end of the shaft 32 a sleeve 37 is mounted to which an oar blade 38 is secured.

The steering arm 14 comprises a pair of elongated body plates 40 inclined forwardly and upwardly and rigidly interconnected through three members which form spacers for the body plates and also serve other purposes. Thus, between the upper portions of the body plates 40 a first spacer in the form of the lower end portion of a mast tube of square cross-section is secured. The mast tube extends obliquely forwardly and upwardly and carries a wind vane 42 at its upper end. A pair of screw-threaded bolts 43 passed through the mast tube 41 and the body plates retain the mast tube in position.

Spaced below the lower end of the mast tube a second spacer in the form of a square rod 45 having a forwardly projecting pivot pin 46 is held by bolts 44. The pivot pin 46 is journalled by means of antifriction bearings 47 in a bearing sleeve 48 received in a bearing portion 24A of the support 24. The axis V of the pivot pin and, accordingly, the pivot axis of the steering arm 14, which constitutes a two-armed lever, is situated in a plane which contains the axis C of the bracket axle 23; when the bracket is properly attached this plane is the longitudinal centre plane of the yacht. As best shown in FIG. 2, the axis V is slightly inclined forwardly and upwardly. In the illustrated embodiment, the angle of inclination of the axis V to the plane containing the designed water line is about 10°, and, accordingly, the angle included between the axes V and C is about 32°. Naturally, the angle of inclination may have other numerical values, e.g. 5°–20°. As best shown in FIG. 2, the axes V and C intersect within or near the region swept by the steering arm during its pivotal motion.

Secured to the square rod 45 is a bent sheet metal lug 49 which extends forwardly over the bearing portion 48 of the bracket 24. This lug, in cooperation with a pair of abutments (not shown in detail) on the bearing portion, limits the pivotal motion of the steering arm 14 about the axis V to an angle of about 35° in either direction from a vertical neutral position.

The third spacer is a counterweight 50 at the lower end of the body plates 40. The counterweight is in the form of a circular cylindrical block having two axial grooves receiving the body plates and is adjustably held to the body plates by set screws 51.

At a point between the square rod 45 and the counterweight 50, the body plates 40 support, through the intermediary of a pivot pin 52, a pivotable elongated bearing block 53 forming part of the linkage 16. Adjacent one end thereof the bearing block 53 is mounted on the pivot pin 52, and adjacent its other end the bearing block is provided with a retaining member 54, such as a pin, by which it may be fixed with respect to the body plates in a selected position, namely in one of two or more predetermined setting positions.

At the last-mentioned end, the bearing block 53 has a cylindrical recess 55 opening into the end face in which recess a sliding block 56 of plastic is axially displaceable. The sliding block constitutes one member of a ball joint the other member of which is constituted by a ball-shaped head 57 of the link rod 35. Thus, the connection between the link rod 35 and the bearing block is constituted by a joint that permits not only omnidirectional pivotal movements about the pivot point P and relative rotational movements of the link rod 35 and the bearing block 53, but also relative axial movements of the link rod and the bearing block.

Pivotal adjustment of the bearing block 53 about the pivot pin 52 will change the distance A between the pivot point P and the axis V, that is, the pivot axis of the steering arm 14. Such adjustment, consequently, will also change the angular transmission ratio for the positively coupled movements of the steering arm 14 and the servo oar 13. Thus, the angle the servo oar 13 is rotated as a consequence of pivotal movement of the steering arm 14 through a certain angle can be selected to suit the conditions of each particular case. Because of the low level of the pivot axis C of the steering arm 14, the angular transmission ratio is favourable for all settings of the bearing block 53. In the embodiment illustrated by way of example, the angular transmission ratio is such that full deflection, 35°, of the steering arm 14 results in a rotation of the servo oar 13 of between 15° and 25°, depending on the setting of the bearing block 53. Thus, in the illustrated embodiment, the angular transmission ratio is always less than unity. In the illustrated neutral position of the steering arm 14, the distance A is only a small fraction, less than 1/10 and preferably less than 1/20, of the perpendicular distance between the centre of the wind vane 42 and the pivot axis V.

Because of the favourable angular transmission ratio for the coupled movements of the steering arm 14 and the servo oar 13 and because of the low frictional resistance to the motion of these components, the steering gear has excellent sensitivity. The sensitivity can be adjusted to suit conditions of the particular case by a simple setting of the bearing block 53.

When the rocker 12 and the steering arm 14 are in the neutral position as shown in FIG. 2, the longitudinal axis of the link rod 35 nearly coincides with the extension of the pivot axis C of the rocker. Moreover, in this position, the pivot point P is positioned on or near the just-mentioned extension, and the axis of the pivot pin 52 of the bearing block 53 is situated near, and is perpendicular to, this extension. Naturally, other arrangements are possible within the scope of the invention.

In the upper end of the mast tube 41, and coaxial therewith, a shaft 60 having an upwardly projecting conical end portion 61 is rotatably mounted. The end portion 61 has a pair of generally axially extending, diametrically opposed grooves 62 into which opposing edges of a pair of tongues 63 of the wind vane 42 are slid such that the wind vane is frictionally held to the shaft end portion 61. A retaining clip 64 or other retaining member secures the wind vane to the shaft end portion 61.

A radially extending actuating rod 65 has one of its ends secured to the shaft end portion 61. Slightly inwardly of the other end, which is provided with a ball-shaped coupling head 66, the actuating rod 65 is provided with an axially displaceable clamping block 67. This block slidably engages an edge of an approximately semi-circular scale plate centered on the axis of the shaft 60. The scale plate is secured to the mast tube 41 and is positioned in a plane which is perpendicular to the axis of the shaft 60.

A screw-threaded portion of the actuating rod 65 carries an internally screw-threaded clamping knob 69 by means of which the clamping block 67 and, consequently, the actuating rod 65, the shaft 60 and the wind vane 42 can be frictionally locked in a selected angular position with respect to the axis of the mast tube 41 and the longitudinal centre line of the steering arm 14. The scale plate 68 has a scale 70 on which the desired setting, that is, a setting corresponding to the desired course of the yacht relative to the wind vector (the apparent wind direction) is selected.

When the illustrated steering gear 10 is to be used to keep the yacht S on a desired course, the rudder coupling tackle 15 is connected to the tiller T and the wind vane 42 is set such that it is parallel to the wind vector when the yacht keeps the desired course.

If the yacht departs from the desired course, that is, if the wind vector includes an angle with the wind vane 42, the steering arm 14 is pivoted to one direction. As a consequence the steering arm 14 imparts a rotational motion to the servo oar 13 through the linkage 16. The rotation of the servo oar 13 will result in a hydrodynamic force on the oar causing the oar and, consequently, the rocker 12 to be pendulously moved about the pivot axis C. The rudder coupling tackle 15 transmits the pendulous motion of the rocker to the tiller T and the rudder R such that the hydrodynamic force on the rudder tends to return the yacht to the desired course corresponding to the setting of the wind vane.

If, for example, the steering arm 14 is pivoted to the left (counter-clockwise) as viewed from a location behind the yacht S and the steering gear 10, the servo oar 13 is rotated counter-clockwise, as viewed from above, about its axis L of rotation. The servo oar and the rocker 12 are then pivoted to the left (clockwise) as viewed from the rear, and the tiller T and the rudder R are rotated counterclockwise, as viewed from above.

If the yacht is to be steered by an electrical compass autopilot, the autopilot output member is connected by a ball joint socket to the coupling head 66 of the actuating rod 65 of the wind vane 42 so that the autopilot can pivot the steering arm 14 in the desired direction. Naturally, in this case the actuating rod 65 is clamped to the scale plate 65 and the mast tube 41 by means of the clamping knob 69. Because of its connection to the upper end of the steering arm 14 and the low friction in the transmission between the steering arm and the servo oar 13, the autopilot consumes very little energy.

Because the servo oar 13 and the rocker 12 may pivot freely relative to the bracket 11 over a very large angular range (at least 90° in either direction), there is hardly any risk for damage of vital parts of the steering gear 10 even when sailing in rough conditions, when the servo oar may be deflected through large angles. If the maximum deflection of the oar cannot be transmitted to the tiller, the consequence at most will be a broken cable or connector (shear plate or the like) of the rudder coupling tackle 15.

In other respects as well, the steering gear 10 is constructed such that any overloading primarily only causes deformation or rupture of inexpensive components which can readily be repaired of replaced. Disregarding the bearings 27, 28, the displaceable joint block 56 and fastening and retaining members, the components of the steering gear are made of aluminium or other light metal.

For practical purposes, the operability of the steering gear of the invention when steering by means of a wind vane, is limited to cases where the angle included between the desired course of the yacht and the wind vector is not greater than about 55°. However, in practice, this limitation is not particularly harmful, because it makes itself felt only in relatively rare sailing conditions. Besides, the known steering gear also does not steer well with side wind and following wind. For that reason, for such winds it is preferred to use an autopilot or steer manually even with the known steering gear.

I claim:

1. Steering gear for a yacht, comprising a bracket adapted for attachment to the transom of a yacht, a rocker supported by the bracket and pivotally movable relative to the bracket about a rocker axis which extend generally in the fore-and-aft direction of the yacht when the bracket is attached to the transom, the rocker being connectable to a rudder member such that the rudder member is deflected in response to pivotal motion of the rocker about the rocker axis, a servo oar supported by the rocker and pivotally movable together with the rocker about the rocker axis, the servo oar being rotatable relative to the rocker about an oar axis which is generally perpendicular to the rocker axis, and a steering arm which is pivotally movable about a steering arm axis and coupled through a linkage to the oar such that the oar is rotated about the oar axis in response to pivotal motion of the steering arm about the steering arm axis, the steering arm axis and the rocker axis intersecting behind the bracket and including between them an angle within the range of 15° to 55°, characterised in that the steering arm is pivotally supported on the bracket such that the steering arm axis is stationary with respect to the rocker axis.

2. Steering gear according to claim 1, characterised in that the steering arm is a two-armed lever, the fulcrum of which is defined by the steering arm axis and one lever arm of which is coupled to the servo oar through the linkage, the outer end of the other lever arm supporting a wind vane which is rotatable about an axis extending generally lengthwise of said other lever arm and which is lockable in selected rotational positions.

3. Steering gear according to claim 2, characterised in that the angular transmission ratio of the motion transverse from the steering arm to the servo oar is less than unity.

4. Steering gear according to claim 2, characterised in that the linkage comprises a pair of elongated link members one of which is connected to the servo oar and the other of which is connected to the steering arm, the link members being interconnected by an articulated joint which permits relative pivotal movement of the link members about a pivot point which is displaceable longitudinally of one of the link members.

5. Steering gear according to claim 4, characterised in that the link member connected to the steering arm is pivotally movable relative to the steering arm about an axis transverse to the steering arm axis and is lockable in selected angular positions.

6. Steering gear according to claim 4, characterised in that the pivot point of the articulated joint is displaceable longitudinally of the link member connected to the steering arm.

7. Steering gear according to claim 2, characterised in that said other lever arm is provided adjacent the wind vane with a member for attachment of an output member of an autopilot.

8. Steering gear according to claim 1, characterised in that the bracket comprises a pedestal, a cantilever axle secured to a pedestal, and a support member which is removably secured to the portion of the axle projecting from the pedestal and on which the steering arm is pivotally mounted, and in that the rocker is journalled on said axle portion by a pair of journal portions straddling the support member.

9. Steering gear according to claim 8, characterised in that the rocker is pivotable relative to the support member over an angular range including substantially one-half of a full turn.

10. Steering gear for a yacht comprising:

a bracket adapted for attachment to the transom of a yacht, said bracket comprising means for attaching said bracket in fixed position to the transom of a yacht, means for pivotally mounting a rocker on said bracket, and means for pivotally mounting a steering arm on said bracket independently of said rocker;

a rocker pivotally mounted on said bracket and being pivotally movble relative to the bracket about a rocker axis which extends generally in the fore and aft direction of the yacht when the bracket is attached to the transom and being connectable to a rudder member such that the rudder member is deflected in response to pivotal motion of the rocker about the rocker axis;

a servo oar supported by the rocker and pivotally movable together with the rocker about the rocker axis, the servo oar being rotatable relative to the rocker about an oar axis which is generally perpendicular to the rocker axis;

a steering arm pivotally mounted on said bracket independently of said rocker, said steering arm being pivotally moveable about a steering arm axis; and linkage means coupling the steering arm to the oar such that the oar is rotated about the oar axis in response to pivotal motion of the steering arm axis.

11. Steering gear according to claim 10 in which the rocker is pivotable relative to the support member over an angular range including substantially one-half of a full turn.

12. Steering gear according to claim 10 in which the rocker axis and the oar axis intersect at a point behind the free end of the axle.

13. Steering gear according to claim 10 wherein said means for attaching said bracket to said transom comprises a pedestal, said means for mounting said rocker on said bracket comprises a cantilever axle fixedly secured to said pedestal such that a portion of said axle projects outwardly from said pedestal, wherein said means for pivotally mounting said steering arm on said bracket comprises a support member removably secured in fixed position to the outwardly projecting portion of said axle, and wherein said rocker is journalled on the outwardly projecting portion of said axle by a pair of journal portions straddling said support member.

* * * * *